United States Patent [19]

Deering

[11] 4,010,092

[45] Mar. 1, 1977

[54] OIL SHALE RETORTING-GASIFICATION PROCESS

[75] Inventor: Roland F. Deering, Brea, Calif.

[73] Assignee: Union Oil Company of California, Los Angeles, Calif.

[22] Filed: May 10, 1974

[21] Appl. No.: 468,927

[52] U.S. Cl. ..... 208/11 R; 48/197 R

[51] Int. Cl.[2] ..... C10G 1/02

[58] Field of Search ..... 208/11; 48/197 R

[56] References Cited

UNITED STATES PATENTS

| | | | |
|---|---|---|---|
| 3,086,853 | 4/1963 | Brandberg | 48/197 R |
| 3,224,954 | 12/1965 | Schlinger et al. | 208/11 |
| 3,228,869 | 1/1966 | Irish | 208/11 |
| 3,361,644 | 1/1968 | Deering | 208/11 |
| 3,384,569 | 5/1968 | Peet | 208/11 |
| 3,475,319 | 10/1969 | MacLaren | 208/11 |
| 3,487,001 | 12/1969 | Needham | 208/11 |
| 3,577,338 | 5/1971 | Gifford | 208/11 |
| 3,617,468 | 11/1971 | Reyburn et al. | 208/11 R |
| 3,703,052 | 11/1972 | Linden | 208/11 R |
| 3,736,247 | 5/1973 | Jones et al. | 208/11 |
| 3,841,992 | 10/1974 | Jones et al. | 208/11 R |

*Primary Examiner*—Delbert E. Gantz
*Assistant Examiner*—James W. Hellwege
*Attorney, Agent, or Firm*—Lannas S. Henderson; Richard C. Hartman; Dean Sandford

[57] ABSTRACT

Spent, coke-containing shale derived from a gas-heated eduction zone is passed through a combustion-gasification zone countercurrently to an upflowing mixture of steam and oxygen-containing gas to effect partial combustion of the coke on the spent shale, the resulting heat of combustion being used to effect concurrent endothermic gasification reactions of steam with unburned coke. The resulting net production of hot, steam- and hydrogen-containing water gas is then mixed with hot recycle gas derived from the shale eduction zone, the resulting mixture forming the heat carrier required for the gas-heated eduction zone. A recycle portion of the steam-rich water gas from the combustion-gasification zone is continuously withdrawn, passed through a steam generator to effect simultaneous cooling and steam enrichment thereof, and then recycled to the bottom of the gasification reactor. In this manner, a substantial portion of the necessary gaseous heat-carrying capacity is provided in the combustion-gasification zone without losing the heat of vaporization of the steam in the recycle portion of water gas. A surprising aspect of the invention is that even though the recycled water gas contains hydrogen, and must pass through the combustion-gasification zone in which hydrogen-burning temperatures prevail, the overall yield of hydrogen is not significantly affected.

6 Claims, 1 Drawing Figure

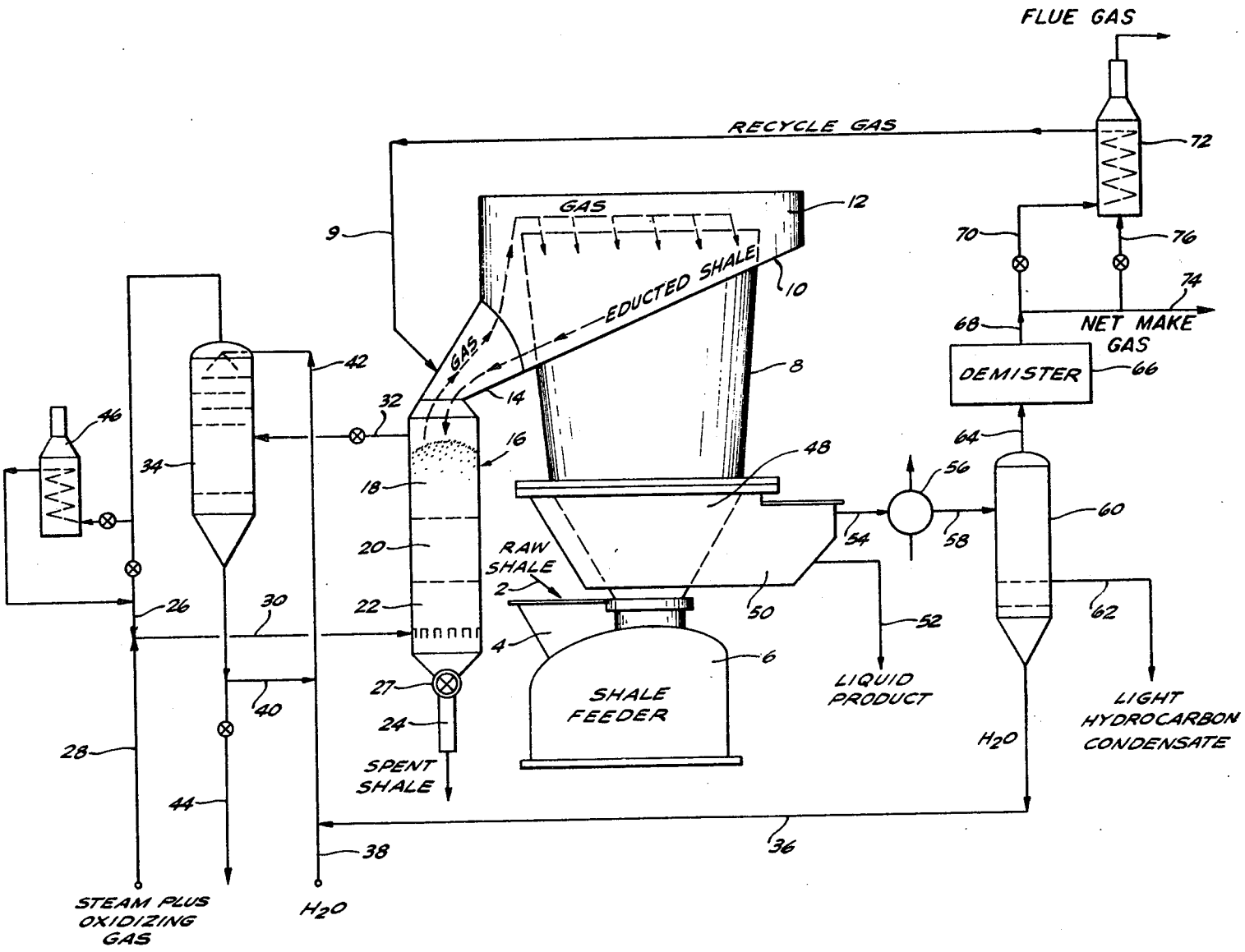
FLUE GAS
RECYCLE GAS
NET MAKE GAS
DEMISTER
LIGHT HYDROCARBON CONDENSATE
LIQUID PRODUCT
EDUCTED SHALE
GAS
SHALE FEEDER
RAW SHALE
SPENT SHALE
$H_2O$
$H_2O$
STEAM PLUS OXIDIZING GAS

OIL SHALE RETORTING-GASIFICATION PROCESS

BACKGROUND AND SUMMARY OF INVENTION

A great many methods have previously been proposed for recovering oil from oil shale, nearly all of which involve some form of pyrolytic eduction. However, for a variety of economic reasons, none of these methods has yet proven competitive with the production of mineral oils from petroleum sources. It may be said in general that the principal overall difficulty resides in recovering essentially all of the hydrocarbonaceous material from the shale without resorting to prohibitively expensive methods. Since shale rock usually contains only about 20–80 gallons of oil per ton, it is a practical necessity to recover at least about 80–90 percent of this oil, and in the most economical possible fashion. It is not essential however that all of this oil be recovered as liquid product; combustible gaseous products can also be economically utilized in the eduction process itself, or in other ways. The overall objective remains to recover the maximum possible energy values at minimum expense. This includes a maximum conservation of heat in the process.

Due to the expense involved in transporting raw shale rock and disposing of spent shale, it is a practical necessity in most eduction processes that the reporting facilities be located closely adjacent to the mining site. These mining sites are nearly always located some distance from refining facilities. Transporting the educted shale oil to such refining facilities has proven to be a problem, mainly because the high nitrogen content of shale oils renders them incompatible with crude petroleum and unsuited for transportation in common carrier pipelines. It should be highly desirable to provide at the retorting site at least sufficient refining facilities to convert the crude shale oil to a pipelineable material. The most desirable refining process for this purpose would be a catalytic hydrofining unit, but this has generally been considered impractical because of the expense involved in providing a suitable source of hydrogen. According to my process, a suitable such hydrogen source is integrated into the retorting system itself, thus providing the needed hydrogen at minimum expense.

Briefly, in my process, spent, hot, coke-containing shale produced for example by the method described in my prior U.S. Pat. No. 3,361,644, is gravitated downwardly through a gasifier in which is maintained a combustion-gasification zone, and a mixture of oxygen-containing gas and steam is passed upwardly countercurrently therethrough. The amount of oxygen injected is controlled to burn only sufficient coke to produce the amount of heat required to gasify a predetermined remaining portion of coke via the endothermic gasification reactions such as:

$$2\,CH^{(a)} \xrightarrow{H_2O} 2C + H_2 \quad (1)$$

$$C + 2H_2O \longrightarrow CO_2 + 2H_2 \quad (2)$$

$$C + H_2O \longrightarrow CO + H_2 \quad (3)$$

$$C + CO_2 \longrightarrow 2CO \quad (4)$$

-continued $$CO + H_2O \rightleftharpoons CO_2 + H_2 \quad (5)$$

[a]"CH" is the approximate molar composition of the original coke on spent shale. Reaction (1) is catalyzed by water vapor.

The resulting essentially oxygen-free product gas will be designated herein as "water gas" even though that term conventionally refers to mixtures much richer in carbon monoxide and leaner in carbon dioxide than those produced herein.

It should be noted at this point that in order to maintain optimum temperature profiles in the gasifier, it is necessary to provide therein a total gaseous heat carrying capacity considerably greater than that which would be provided simply by the stoichiometric quantities of steam and oxidizing gas required to gasify the coke on the spent shale. The total heat capacity of the gas stream in the gasifier should be approximately equal to the heat capacity of the spent shale supplied thereto. For example, if the spent shale rate is 200 tons per hour and the shale gives up 112,000 Btu's per hour per degree Fahrenheit in cooling, the quantity of gas moving up the gasifier should be sufficient to absorb 112,000 Btu's per hour per degree Fahrenheit in the process of heating up.

To provide the necessary heat capacity in the gas stream, it is desirable to utilize an excess of water vapor, which not only provides high heat-carrying capacity but also is advantageous in shifting the equilibrium of reaction (5) above to the right. However, one problem involved in the use of excess steam is that of conserving the heat of vaporization of the unconsumed excess thereof in the water gas product. To produce a useful product gas, most of the excess steam must ultimately be condensed out, involving a substantial evolution of 212° F-minus heat, which cannot be economically utilized in the retorting or gasification operations. I have found that a substantial proportion of this heat loss can be avoided by withdrawing a recycle stream of the water gas product (which is ordinarily at a temperature of about 850°–1100° F), passing it through a steam generator to effect simultaneous cooling and steam-enrichment thereof, and then returning the enriched gas to the lower portion of the gasifier. By operating in this manner, a substantial proportion of the steam required for heat carrying in the gasifier is never condensed, with resultant heat savings amounting to about 400,000 to 500,000 Btu's per ton of raw shale.

It is noteworthy that although the recycle water gas stream contains hydrogen and must pass through the combustion-gasification zone in which hydrogen-burning temperatures prevail, there is substantially no net reduction in overall hydrogen yields. With the oxygen supply limited so that only a portion of the coke can be burned, it appears that the kinetics of the various reactions occurring in the combustion-gasification zone are such that the heat produced from any burning of hydrogen merely relieves an equivalent proportion of carbon from its heat-producing duty and renders it available for hydrogen production via the endothermic gasification reactions. Consequently there is substantially no net reduction in overall hydrogen production.

The net unrecycled product portion of water gas from the gasification zone is mixed with a major proportion of preheated retort off-gas comprising mainly carbon dioxide, hydrogen and light hydrocarbons (and nitrogen if air is used as the oxidizing gas), and the resulting hot gas mixture is then passed through the retorting zone countercurrently to a stream of crushed shale rock to effect oil eduction by pyrolysis of kerogens. The large volume of retort recycle gas is required in order that the necessary heat for eduction can be supplied without preheating the smaller volume of water gas from the gasification zone to such high temperatures as to bring about undue cracking of the educted oil. High temperature gases are also undesirable because heat is unnecessarily wasted in the endothermic decomposition of mineral carbonates in the spent shale.

The combined eduction gases and product oil are then recovered from the eduction zone and separated as described more in detail hereinafter. When air is used as the oxidizing gas in the gasification zone, the retort off-gas will comprise a large proportion of nitrogen and will have a relatively low heating value. Where substantially pure oxygen is employed in the gasification zone, a high Btu off-gas is obtained which is much richer in hydrogen, and from which carbon dioxide can be separated to produce a 70–90 percent hydrogen gas stream suitable for use in a catalytic hydrofiner to upgrade the liquid shale oil produced.

A particularly desirable modification of my process involves the use of at least one retort operating with an oxygen gasification zone, in combination with at least one retort operating with an air gasification zone. The former retort or retorts produce hydrogen for hydrofining, while the latter produces low Btu heating gas to supply the thermal requirements of the combined retorting and gasification systems.

I am aware that combined shale retorting-gasification processes have previously been proposed, for example those described in U.S. Pat. Nos. 3,577,338 and 3,736,247. However, in these processes the raw shale is passed downwardly through the retorting zone and continuously into the gasification zone, while the necessary recycle gas for eduction (comprised of product gas from the retorting zone) is introduced at the bottom of the gasification zone and passed upwardly, first through the gasification zone and then through the eduction zone. Steam and oxygen are introduced at intermediate levels to effect gasification. I have found these procedures to be disadvantageous from several standpoints. Firstly, it is difficult to maintain a sharp separation between the eduction and the gasification zones. Educted oil in the top of the retort tends to reflux downwardly into the hotter gasification zone where cracking may occur, and where they may be unconsumed oxygen. But even more importantly, I have found that it is disadvantageous to pass retort off-gas through the gasification zone, for two principal reasons:

Firstly, prior to reheating for recycle, this product gas has of necessity been cooled to condense out most of the vaporized retort hydrocarbons, and concomitantly water vapor is condensed with the result that only a low equilibrium concentration thereof remains in the recycle gas. As noted above, in the gasification zone it is desirable to maintain a high partial pressure of water vapor. If sufficient steam is added to the retort recycle gas to achieve this objective in the above noted prior art processes, there would be excess gaseous heat carrying capacity, both in the gasification and retorting zones. Moreover, inordinate amounts of steam would need to be generated and condensed with each pass through the system, necessarily entailing large heat losses.

Secondary, the retort product gas contains about 2–10 volume percent of light hydrocarbons which are burned preferentially in the combustion-gasification zone. The only way, in this operation, that the coke on spent shale can produce a useful product is by reaction with steam and carbon dioxide. It has been found that the hydrocarbons in the recycle gas suppress the gasification reactions so that less than half of the coke on spent shale can be gasified in this manner. As a result, more than 10% of the recoverable energy in the raw shale is lost to the ash discard. These considerations appear not to have been properly evaluated in prior art gasification-retorting processes.

It is an important feature of my invention to introduce the retort recycle gas into an essentially oxygen-free transition zone maintained between the gasification and eduction zones, and in which the spent shale has not yet been heated to above about 1100° F. This permits control of the total volume of gas flowing into the pyrolysis zone so that the optimum gas to solids ratio can be obtained therein. The temperature of the gas entering the pyrolysis zone also can be controlled and optimized. The temperature of the total gas (water gas plus retort recycle gas) entering the pyrolysis zone can be adjusted by controlling the temperature of the retort recycle gas.

Finally, I am unaware of any prior art moving-bed gasification process which embodies the highly advantageous heat-conserving feature of my invention, involving the recycle of a portion of the gasifier product gas through a steam generator and thence back into the lower section of the gasifier.

DETAILED DESCRIPTION

Any of a large number of naturally occurring oil-producing solids can be used in my process. The characteristics of these materials are generally well known and hence need not be described in detail. For practical purposes, however, the raw shale should contain at least about 10, preferably at least 20, and usually between about 20 and about 80 gallons of oil per ton of raw shale by Fischer assay. The shale should be crushed to produce a raw shale feed having no particles greater than 6 inches and preferably none greater than 3 inches mean diameter. Average particle sizes of about ⅛-inch to about 2 inches mean diameter are preferred.

The process may best be understood by reference to the drawing which is a schematic illustration of one embodiment of the invention. It will be understood that for the sake of simplicity conventional pumps, compressors, level-control devices, etc. have been omitted.

Referring now to the drawing, raw crushed oil shale is fed at 2 into hopper 4 of shale feeder 6 from which it is pumped upwardly into retort 8. The details of shale feeder 6 are described in more detail in my above-noted U.S. Pat. No. 3.361,644. The shale feed rate will, of course, vary considerably depending upon the size of the retort and the desired holding time therein.

The raw shale passes upwardly through retort 8, traversing a lower preheating zone and an upper pyrolysis zone. Temperatures in the lower portion of the retort are sufficiently low to condense product oil vapors from the superjacent pyrolysis zone. As the shale progresses upwardly through the retort its temperature is gradually increased to eduction levels by counter-currently flowing eduction gases comprising a preheated recycle portion of retort make-gas from line 9, and the net make of water gas from gasifier 16. Eduction temperatures are conventional, usually in excess of about 600° F, and preferably between about 700° and about 1000° F. Essentially all of the oil will have been educted from the shale by the time it reaches a temperature of about 900° F. Gas temperatures above about 1300° F in the eduction zone should not be exceeded since they result in excessive shale oil cracking. Other retorting conditions include shale residence times in excess of about 10 minutes, usually about 30 minutes to about 1 hour, sufficient to educt the desired amount of oil at the selected retort temperatures. Shale feed rates usually exceed about 100, and are preferably between about 400 and about 1000 pounds per hour per square foot cross-sectional area in the retort. These values refer to average cross-sectional areas in the tapered retort illustrated in the drawing.

Pressure in the retort may be either subatmospheric, atmospheric or superatmospheric. Retorting pressures normally exceed about 0.5 and are preferably about 5 to about 400 psig. Heating gas temperatures and flow rates must be sufficient to heat the crushed shale to pyrolysis temperatures. Heat transfer rates depend in large part on the heating gas flow rate, temperature and heat capacity. Flow rates of at least about 3000, generally at least about 8000 and preferably between about 10,000 and about 40,000 SCF of total heating gas per ton of raw shale are employed. The temperature differential between the heating gas and solids at the top of the pyrolysis zone is usually between 10° and 100° F. Excessive temperature differentials, e.g., in excess of about 400° F, should be avoided.

The retorted oil shale overflowing the top of the retort 8 falls onto the inclined peripheral floor 10 of shroud 12, which is affixed in fluid-tight fashion to the outer wall of the retort. The retorted shale then gravitates down floor 12 through chute 14 into the top of vertical gasifier 16, in which is maintained a spent shale preheating zone 18, a combustion-gasification zone 20 and an ash cooling zone 22. The retorted shale is essentially oil-free and will contain at least about 2%, usually between 3% and about 5%, and preferably at least 3% by weight of carbon as coke.

In shroud 12, chute 14 and preheating zone 18, the retorted shale will ordinarily be at a temperature below about 1100° F. These transition zones are also essentially oxygen-free, and accordingly the retort recycle gas can be introduced into any one or more of such zones.

Downflowing spent shale in gasifier 16 is first preheated by direct heat exchange with the upflowing gas stream in preheating zone 18, and is then gasified in combustion-gasification zone 20 by countercurrent contact with steam and oxygen. Peak temperatures in zone 20 should be sufficiently high to react at least about 20% of the coke with steam to give hydrogen and carbon oxides. Some degree of gasification can be obtained at temperatures as low as 1000° F. However, peak temperatures above 1100° F, preferably between about 1200° and 1800° F are usually required to obtain feasible gasification rates. Extreme temperatures, e.g., on the order of 2000° F, should be avoided to minimize carbonate decomposition and shale ash fusion, commonly referred to as clinkering. Reaction times should be on the order of at least about 5 minutes, preferably at least about 20 minutes. In cooling zone 22 the shale ash temperature is normally reduced to about 200°–500° F. The inlet temperature of the steam-oxygen mixture admitted to cooling zone 22 via line 30 will ordinarily range between about 150° and 1000° F, preferably about 200°–500° F.

Spent shale ash is discharged from gasifier 16 via ash outlet 24 controlled by solids flow controller 27, which may be a star feeder or a vane feeder or the like, and operates to control the solids level in gasifier 16. A mixture of makeup steam and air or oxygen is brought in via line 28, and admixed with steam-enriched gasifier recycle gas from line 26. The resulting mixture is then passed into the bottom of cooling zone 22 via line 30. Oxygen addition rates are between about 25 lbs and 250 lbs, and preferably between about 50 and 150 lbs per ton of raw shale. The amount to be used depends primarily upon the coke content of the retorted shale. For spent shale containing e.g., 4–5 weight percent of coke, it is normally desirable to provide sufficient oxygen to convert (theoretically) about 30–50 percent of the carbon content of the coke to $CO_2$. This provides the necessary heat to give substantially complete gasification of the remaining coke.

Steam addition to the combustion-gasification zone, including recycled steam, may range between about 200–1000, preferably between about 250 and 800 pounds per ton of raw shale if oxygen is used as the oxidizing gas. If air is used as the oxidizing gas about 20–50 percent less steam is needed, since the nitrogen in the air supplies part of the heat-carrying capacity.

The water gas product emerging from the top of preheating zone 18 is normally at a temperature of around 800°–1100° F, and is composed primarily of water vapor, carbon dioxide, and hydrogen (and nitrogen if air was used as the oxidizing gas).

As previously noted, stable operation of gasifier 16 requires more gaseous heat carrying capacity in the gases entering via line 30 then would be supplied merely by the chemically required oxygen and steam. If additional gaseous heat carrier is not supplied, the combustion in zone 20 (in which peak temperatures prevail) will descend into cooling zone 22, and conversely if too much gaseous heat carrier is employed peak temperatures will rise into preheating zone 18 and combustion may eventually be extinguished. Since steam is as noted an advantageous heat carrier, an excess thereof is employed, sufficient to render the heat carrying capacity of the total gas stream approximately equal to the heat carrying capacity of the downflowing solids.

In the past the entire water gas product from the gasifier, with its excess water vapor, was passed first through retort 8 in order to utilize its useful sensible heat content for eduction purposes and then, in admixture with retort make gases, was passed through an air cooler to condense out light hydrocarbons and water and thereby recover a useful total make gas. In this system, all the heat of vaporization of the water vapor from the gasifier was lost since water vapor would either be condensed out at temperatures below 212° F, or leave the system at its low dew-point concentration in the retort off-gases. Consequently it was necessary to revaporize all water needed for each pass through the gasifier.

It has now been discovered however that a substantial proportion of this heat loss can be avoided by operating the gasifier with an internal recycle of water gas. In the drawing, this recycle water gas stream, which normally amounts to about 20–50 volume percent of the total gas effluent from the gasifier, is withdrawn via line 32 and passed into steam generator 34, in which steam is generated with concomitant cooling of the recycle gas. At the same time, fines are scrubbed from the recycle gas. Water is supplied to steam generator 34 via condensate water recycle line 36, makeup water line 38, and internal recycle line 40, all of which feed into the top of steam generator 34 via line 42. In steam generator 34, liquid water cascades downwardly, countercurrently to the rising recycle gas from line 32 whereby simultaneous steam generation, recycle gas cooling and scrubbing take place. The steam-enriched recycle gas is then withdrawn overhead via line 26 as previously described. Excess liquid water accumulating in steam generator 34 is in part recycled internally via lines 40 and 42, and is in part withdrawn to blowdown via line 44 to remove dissolved and suspended solids from the system.

Auxiliary gasifier recycle gas heater 46 is provided for startup purposes to assist in establishing the desired temperature profile in gasifier 16. After startup, heater 46 is either bypassed or turned down to low firing, as needed.

In shale retort 8, eduction gases and product oil flow downwardly into the cooler, condensing portion thereof, and thence into slotted, frusto-conical product disengagement zone 48, from which product oil and vapors flow into product collection tank 50. Liquid product is withdrawn therefrom via line 52, and vapor effluent is withdrawn via line 54 at a temperature of, e.g., 200°–300° F. To recover light hydrocarbons therefrom the vapor effluent is passed through an air cooler 56 and thence via line 58 at a temperature of e.g., 100°–150° F into separator 60. Condensed water is recovered therefrom and recycled via line 36 as previously described, while the light hydrocarbon condensate is withdrawn via line 62.

Overhead product gas from separator 60, comprising mainly carbon oxides, hydrogen, light hydrocarbons and steam (and nitrogen if air was used as the oxidizing gas), as well as some suspended shale oil mist, is taken overhead via line 64 and passed through a demisting unit 66, which may comprise a conventional circulating oil scrubber. The demisted gas from demister 66 is withdrawn via line 68, and disposed of according to two principal alternatives.

According to the first alternative, it is assumed that the oxidizing gas used in gasifier 16 was air, in which case the off-gas in line 66 has a low heating value, useful primarily as fuel gas and as a heat carrier for the retorting zone. For the latter purpose, a recycle portion is passed via line 70 through fired heater 72 and thence recycled via line 9 as previously described. Another portion of the off-gas in line 68 is withdrawn as net make gas via line 74, and may be utilized as fuel gas in another gasification-retorting unit which is being operated with an oxygen gasification zone to produce a hydrogen-rich off-gas having higher than mere heating value. Another portion of the make-gas in line 74 is withdrawn via line 76 for use as fuel in heater 72.

If oxygen, or a gas rich in oxygen (containing e.g., more than about 50% oxygen) was used in gasifier 16, the resulting off-gas in line 66 is much richer in hydrogen, and accordingly the portion not recycled via line 70 is preferably withdrawn via line 74, and the heating requirement for preheater 72 is supplied by gases derived from other sources. The nominal concentration of hydrogen in the net make-gas derived from a pure oxygen gasifier-retorting combination usually ranges between about 15 and 40 volume percent. It also contains about 30–70 percent $CO_2$, 2–6 percent light hydrocarbons having up to about 8 carbon atoms and minor amounts, e.g., less than 5 percent of $H_2S$ and carbon monoxide.

In the air gasification-retorting systems, the volume of gas recycled via line 9 to the retort should be at least about 2000 and preferably between about 5000 and 25,000 SCF per ton of raw shale feed. In oxygen gasification-retorting systems, the required retort recycle gas rates are normally about 10–30 percent less than that required for the air gasifier-retorting systems.

Retort recycle gas is employed in order to increase the volume and heat capacity of the gases entering the retorting zone. By this procedure the same amount of heat can be conducted to the retorting zone at a lower temperature thereby minimizing over-cracking and affording more versatile temperature control in the pyrolysis and shale preheating zone.

Introduction of the retort recycle stream to an essentially oxygen-free zone downstream of the combustion-gasification zone results in additional advantages. Firstly, the hydrocarbons in the recycle gas do not interfere with the combustion and gasification of coke on retorted shale in the gasifier. The water vapor partial pressure in the combustion-gasification zone is correspondingly higher resulting in higher hydrogen production rates and yields.

Also, because the preferred recycle procedure raises the partial pressure of water vapor in the combustion-gasification zone, lower temperatures can be maintained, thereby minimizing carbonate decomposition and avoiding clinkering. Acceptable gasification rates can be maintained at lower temperatures due to higher water vapor partial pressures. The consequent reduction in carbonate decomposition further reduces heating requirements and product gas dilution. Keeping retort recycle gas out of the gasification zone also results in a more inert ash due to more complete coke consumption, and spent ash handling and disposal is simplified considerably.

The following example is cited to illustrate specific preferred commercial operations hereunder, but is not to be construed as limiting in scope:

EXAMPLE

In this Example, two operations are compared, in one of which cryogenic oxygen is utilized in the gasifier and in the other of which air is used. Both cases are compared on the basis of a retorting unit to which 5000 tons per stream day of 34 gallon per ton (Fischer assay) crushed shale is fed to a retort similar to that illustrated in the drawing, operating at a pressure of 10 psig. The principal operating conditions and results are as follows:

Table 1

| Temperatures, °F | Oxygen Gasifier | Air Gasifier |
|---|---|---|
| Raw Shale | 60 | 60 |
| Eduction maximum (solids) | 950 | 950 |

Table 1-continued

| Temperatures, °F | Oxygen Gasifier | Air Gasifier |
|---|---|---|
| Eduction gas maximum | 1000 | 1000 |
| Gasification maximum | 1500 | 1500 |
| Ash from gasification cooling zones | 300 | 300 |
| Inlet gases to gasification zones | 250 | 250 |
| Gas Rates per Ton of Raw Shale | | |
| Steam to gasification zones | | |
| Recycled from gasification zone | 234 lbs | 117 lbs |
| Generated in steam generator | 100 lbs | 100 lbs |
| Extraneous makeup | 300 lbs | 100 lbs |
| Oxidizing gas to gasification zones | 95 lbs $O_2$ | 500 lbs Air |
| Retort recycle gas to retorting zones | 10,650 SCF | 12,770 SCF |
| Gasifier make-gas to retorting zones | 13,930 SCF | 13,930 SCF |
| Gasifier off-gas recycled to gasification zones | 6,710 SCF | 7,886 SCF |
| Approximate Residence Times, Hrs. | | |
| Of shale at 800–1000° F eduction temperatures | 0.50 | 0.50 |
| Of spent shale at 1000-1500° F gasification temperatures | 0.30 | 0.30 |
| Product Yields | | |
| Full-range shale oil | 3845 B/D | 3845 B/D |
| Net product gas | 35.7 MM SCF/D | 59.5 Mm SCF/D |

The composition of the raw retort product gases (as well as the retort recycle gases) is as follows:

Table 2

| Volume-Percent | Oxygen Gasified | Air Gasifier |
|---|---|---|
| $H_2$ | 25.2 | 15.1 |
| $H_2S$ | 0.9 | 0.6 |
| $CO_2$ | 54.7 | 32.8 |
| CO | 2.8 | 1.7 |
| $C_1$–$C_6$ | 6.0 | 3.5 |
| $H_2O$ | 10.4 | 10.4 |
| $N_2$ | nil | 35.9 |

If the respective retort recycle gases in the foregoing example were recycled through the combustion-gasification zones, only a small fraction of the residual coke on the retorted shale fed to the gasifier would be gasified and the yield of hydrogen would be too low to provide an economical source thereof.

By virtue of the above gas recycle maintained in the respective gasification zones, a heat saving of about 370,000 Btu's per ton of raw shale is obtained in the oxygen gasification case, and about 415,000 Btu's per ton in the air gasification case.

Numerous variations and modifications of the concept of this invention will be apparent to one skilled in the art in view of the foregoing disclosure and the appended claims.

I claim:

1. In a process for producing shale oil and a hydrogen-containing product gas, wherein a stream of raw crushed shale is first countercurrently contacted in an eduction zone with a stream of essentially oxygen-free, hot eduction gas to thereby produce shale oil, an eduction off-gas and hot, essentially oil-free, coke-containing spent shale, and wherein said hot spent shale is thereafter countercurrently contacted in a gasification zone with a conversion gas mixture comprising steam and oxygen to partially combust the coke on said spent shale and thereby heat said spent shale to sufficiently high peak temperatures, between about 1200° and 1800° F, to react said stream with remaining coke, thereby producing an essentially oxygen-free, hydrogen-containing water gas, and wherein said eduction gas comprises a mixture of water gas and a recycle portion of said eduction off-gas, the improvements which comprise:

1. passing said raw shale upwardly through said eduction zone, and said spent shale downwardly through said gasification zone;
2. maintaining an essentially oxygen-free transition zone between said eduction zone and said gasification zone;
3. passing said spent shale through said transition zone into said gasification zone;
4. passing a first portion of said water gas through said transition zone into said eduction zone;
5. contacting a second portion of said water gas, comprising about 20–50% of the total thereof, with liquid water in a steam generation zone to effect simultaneous cooling and steam-enrichment thereof;
6. recycling the steam-enriched water gas from step (5) through said gasification zone;
7. injecting said recycle portion of eduction off-gas into said transition zone to mingle therein with said first portion of water gas and form said eduction gas; and
8. withdrawing the non-recycled portion of said eduction off-gas as said hydrogen-containing product gas, none of said eduction off-gas being recycled through said gasification zone.

2. A process as defined in claim 1 wherein the solids temperature in said transition zone is below about 1100° F.

3. A process as defined in claim 1 wherein said conversion gas mixture is essentially air and steam.

4. A process as defined in claim 1 wherein said conversion gas mixture is essentially steam and an oxidizing gas comprising at least 50 volume-percent oxygen.

5. A process as defined in claim 4 wherein said oxidizing gas comprises at least about 80 volume-percent oxygen.

6. A process as defined in claim 1 wherein sufficient steam is employed in said conversion gas mixture to maintain therein a heat-carrying capacity substantially equal to the heat-carrying capacity of said spent shale.

* * * * *